US011311898B2

(12) United States Patent
Draskoczy

(10) Patent No.: US 11,311,898 B2
(45) Date of Patent: Apr. 26, 2022

(54) DEVICE AND INSTALLATION FOR THE ELECTROSTATIC POWDER COATING OF OBJECTS

(71) Applicant: QUICKCOATING GMBH, Reutlingen (DE)

(72) Inventor: Botond Draskoczy, Reutlingen (DE)

(73) Assignee: QUICKCOATING GMBH, Reutlingen (DE)

( * ) Notice: Subject to any disclaimer, the term of this patent is extended or adjusted under 35 U.S.C. 154(b) by 0 days.

(21) Appl. No.: 16/955,300

(22) PCT Filed: Dec. 17, 2018

(86) PCT No.: PCT/EP2018/085163
§ 371 (c)(1),
(2) Date: Jun. 18, 2020

(87) PCT Pub. No.: WO2019/121489
PCT Pub. Date: Jun. 27, 2019

(65) Prior Publication Data

US 2021/0016305 A1 Jan. 21, 2021

(30) Foreign Application Priority Data

Dec. 18, 2017 (DE) ..... 10 2017 130 289.1

(51) Int. Cl.
*B05B 7/14* (2006.01)
*B05B 16/40* (2018.01)
(Continued)

(52) U.S. Cl.
CPC ..... *B05B 7/1454* (2013.01); *B05B 5/0255* (2013.01); *B05B 16/40* (2018.02);
(Continued)

(58) Field of Classification Search
USPC ..... 118/308, 309, 620–640
See application file for complete search history.

(56) References Cited

U.S. PATENT DOCUMENTS 3,817,211 A * 6/1974 Brown ..... D06M 15/71 118/630
3,918,401 A * 11/1975 Blakeslee ..... B05B 7/1486 118/630

(Continued)

FOREIGN PATENT DOCUMENTS

DE 69506790 T2 7/1999
DE 59331148 T2 7/2002

(Continued)

OTHER PUBLICATIONS

European Patent Office, International Search Report for International Application No. PCT/EP2018/085163, dated Mar. 14, 2019 (Mar. 14, 2019), 3 pages, Rijswijk, Netherlands (NL).

(Continued)

*Primary Examiner* — Yewebdar T Tadesse
(74) *Attorney, Agent, or Firm* — Christopher C. Dremann, P.C.; Christopher C. Dremann

(57) ABSTRACT

A device for the powder coating of objects includes a main body on which an electrode arrangement designed for producing a powder cloud is arranged and on which a metering device is arranged above the electrode arrangement and is designed for the controlled discharge of an amount of a powder onto the electrode arrangement. A powder coating installation is equipped with at least one such device for powder coating.

16 Claims, 9 Drawing Sheets

(51) Int. Cl.
*B05B 5/025* (2006.01)
*B05B 5/08* (2006.01)

(52) U.S. Cl.
CPC ..... *B05B 5/087* (2013.01); *B05B 7/144* (2013.01); *B05D 2401/32* (2013.01)

(56) References Cited

U.S. PATENT DOCUMENTS

| | | | | |
|---|---|---|---|---|
| 3,951,099 | A | 4/1976 | Minckler | |
| 6,294,216 | B1 | 9/2001 | Ikezaki et al. | |
| 2009/0004380 | A1* | 1/2009 | Hochsmann | B29C 64/153 427/203 |

FOREIGN PATENT DOCUMENTS

| | | | |
|---|---|---|---|
| EP | 0693973 | A1 | 1/1996 |
| JP | S63274465 | A | 11/1988 |
| JP | H06304502 | A | 11/1994 |
| JP | H09290183 | A | 11/1997 |
| WO | 94/22589 | A1 | 10/1994 |
| WO | 00/25934 | A1 | 5/2000 |

OTHER PUBLICATIONS

Europäisches Patentamt (European Patent Office), Shriftlicher Bescheid Der Internationalen Recherchenbehörde (Written Opinion for the International Search Report), 8 pages, Europaisches Patentamt, München, Germany (DE).

* cited by examiner

DEVICE AND INSTALLATION FOR THE ELECTROSTATIC POWDER COATING OF OBJECTS

CROSS-REFERENCE TO RELATED APPLICATIONS

This United States non-provisional application is the national stage of International Application No. PCT/EP2018/085163 filed on Dec. 17, 2018, with priority to German Application No. DE 10 2017 130 289.1 filed on Dec. 18, 2017, the entire disclosures of which are incorporated herein by reference.

FIELD OF THE INVENTION

The present invention relates to a powder coating device and also to a powder coating installation equipped with such a device, which are designed for coating objects with a powder or powder coating. The powder coating device and the powder coating installation are designed in particular for pressure-less operation and, to this extent, for generating an expanding, for instance electrostatically charged powder cloud, by means of which a surface of objects located in the area of the powder cloud can be coated.

BACKGROUND OF THE INVENTION

Powder coating devices are sufficiently well known in the prior art. A coating material in the form of powder or granules is atomized, for example by means of electrostatic charging, so that a uniform wetting of a surface of the object to be coated or of a workpiece can take place with high quality. There are a wide variety of concepts and methods for applying the coating material to the surface of objects or workpieces. Apart from spraying on a powder by means of compressed air with the aid of a gun, it is known to arrange the objects or workpieces to be coated in a coating chamber and to expose them there to a powder cloud that spreads out spatially as a result of electrostatic effects.

With such devices, it has until now been customary to place a fixed amount of powder, predetermined for the respective coating operation, in the coating chamber, for example on the bottom of the coating chamber. Provided on the bottom of the coating chamber or in a partial region of it is the electrode arrangement required for generating the powder cloud. The amount of powder introduced into the coating chamber must in this case be made to match as exactly as possible the surface of the workpiece to be coated. If workpieces with different surfaces or shapes are to be coated with such an installation at relatively short successive intervals, this imposes considerable requirements on the correct metering of the amount of powder required for the respective coating operation.

During the coating operation, such powder coating chambers are closed, in order on the one hand to avoid the powder cloud spreading into the surrounding area and in order on the other hand to avoid external influences on the powder coating process. The powder particles swirled up into a powder cloud as a result of the electrostatic charging, or rising up against gravitational force, fall down onto the electrode at regular intervals under the effect of gravity. There, they undergo renewed electrostatic charging, which in turn makes the powder particles concerned rise up. During the coating process, a kind of circulation is thereby produced for the individual powder particles, until they are deposited as intended on the object to be coated.

Such coating processes require manual cyclical operation for coating individual workpieces in the interior space of the coating chamber. In this case, the powder for the respective coating process must usually be introduced manually into the chamber by an end user before the coating process begins, and for example also be distributed on the bottom of the coating chamber.

OBJECT AND SUMMARY OF THE INVENTION

Against this background, the present invention is based on the object of providing an improved powder coating device and powder coating installation that allow in-line or run-through operation for objects to be coated by a coating chamber which provide particularly easy and practical handling for the end user, allow improved monitoring of the coating process, in particular during the coating process, provide easy and practical supplying of powder and are also suitable for reducing powder consumption. The powder coating device and the powder coating installation are also intended to be distinguished by a variable configuration that can be adapted to a wide variety of coating requirements.

This object is achieved by a powder coating device according to the present invention and also by a powder coating installation according to the present invention. Exemplary embodiments of a powder coating device according to the present invention and a powder coating installation according to the present invention, including additional features thereof, are described herein and shown in the accompanying drawing figures.

To this extent, a powder coating device for the powder coating of objects is provided. The powder coating device has a main body, on which an electrode arrangement designed for generating a powder cloud is arranged. Also arranged on the main body is a metering device. The metering device is in this case arranged above the electrode arrangement. As used herein, the term "above" is intended to mean an arrangement with respect to a vertical. The metering device is in this case designed for the monitored discharge of an amount of powder onto the electrode arrangement lying thereunder.

The metering device may in this case be designed for discharging an amount of powder without air pressure onto the electrode arrangement lying thereunder. The discharge onto the electrode arrangement can take place either directly, by trickling down freely, or indirectly by means of being supplied via a kind of chute.

The electrode arrangement and the metering device are arranged on a common main body. This allows the position of the metering device in relation to the electrode arrangement to be predetermined or fixed in a defined way. The main body and the powder coating device, formed for example by the main body, the metering device and the electrode arrangement, can then be arranged in a configurable manner in a coating chamber of a powder coating installation. This allows a universal configuration of a powder coating installation that can be adapted to different coating specifications and also can be adapted variably to the respective user specifications. The powder coating installation may furthermore also be designed as convertible, that is to say designed as configurable at any time to different process requirements, not only during initial installation or production but also retrospectively, i.e. after being put into operation.

The provision of a monitorable metering device also allows the supply of powder to the electrode arrangement to be adjustably changed. It is in particular provided that the metering device is designed for the controllable and changeable, for example steplessly changeable, discharge of an amount of powder onto the electrode arrangement. In particular, the metering device can be activated from outside or by remote control. In this way, the discharge of the amount of powder onto the electrode arrangement can also be variably adapted to the respectively prevailing requirements during an ongoing coating process and without external intervention in the coating chamber.

The fact that the main body, and consequently the entire powder coating device, can be positioned variably in or on the coating chamber of a powder coating installation means that a wide variety of powder clouds, corresponding to the respective coating requirements, with a wide variety of geometries and particle densities, can be generated in a way corresponding to the respective arrangement and positioning and also alignment of the powder coating device in relation to the at least one workpiece or object arranged inside the coating chamber. Consequently, in each case a wide variety of powder clouds, made to match the respective objects, can be generated for a wide variety of coating objects.

According to one embodiment, the metering device of the electrode arrangement has a powder outlet. Since the metering device is located above the electrode arrangement, the powder discharged by the metering device can reach the electrode arrangement under the effect of gravity. On the basis of the electrode arrangement and the electrostatic charging provided by means of the electrode arrangement, a powder cloud that spreads out spatially as a result of the electrostatic charging alone, without the application of compressed air or similar delivery or propulsive media, can then be formed.

The metering device is designed in particular to regulate and control the discharge of the amount of powder per unit of time. In this way, the amount of powder reaching the electrode arrangement, or impinging on it from above, can be specifically set. For this purpose, a charging voltage on or at the electrode may also be variably settable or controllable. Accordingly, the spatial extent and powder density within the powder cloud can also be regulated and controlled according to requirements.

According to another embodiment, the metering device has a screen extending over the powder outlet. This brings about a particularly fine-grained application of the powder onto the electrode arrangement lying thereunder. Any clumping of the powder on the electrode arrangement can in this way be avoided. Furthermore, by providing a screen extending over the powder outlet, it is ensured that a required powder particle size is maintained. The screen may have a mesh width of less than 1 mm. The screen may for example have a mesh width of 100 μm to 1 mm. Also, the screen may have a mesh width of 200 μm to 800 μm. Furthermore, the screen may have a mesh width of 500 μm to 800 μm. Typically and advantageously, the mesh width of the screen is made to match the powder intended for the coating process.

According to yet another embodiment, the metering device has a movably mounted slide with at least one powder receptacle, by means of which in each case an amount of powder corresponding to the size of the powder receptacle can be fed in portions to the electrode arrangement. The slide may for example be mounted movably on the metering device between a receiving position and a discharging position. In the receiving position, the powder receptacle is typically located under a powder supply, for example at the lower end of a feeding funnel of a powder container.

With the powder received in the powder receptacle, the slide can then be transferred into a discharge position, in which the powder receptacle is downwardly open. This may take place for example by the slide being displaced into a region in which the powder receptacle protrudes laterally from a housing of the metering device or in which a bottom of the metering device lying under the powder receptacle has a through-opening corresponding to the powder receptacle. In this way, the powder previously received in the powder receptacle can be discharged downwardly, and consequently onto the electrode arrangement. Thus, the powder receptacle may for example have a through-opening passing vertically through the slide, which in the receiving position is downwardly closed and which in the discharging position is downwardly open.

According to yet another embodiment, the metering device is connected in a powder-conducting manner to a powder store. The metering device may for example be arranged at a lower end of a powder storage container. Inside the powder storage container is the powder store. Under the effect of gravity, the powder or the powder store can pass from the storage container into the metering device, so that it can be fed via the outlet of the metering device to the electrode arrangement.

The powder store may be arranged on the main body of the powder coating device. It may also belong to the powder coating device. It is however also conceivable that the powder store is arranged outside the powder coating device, possibly also outside a coating chamber of a powder coating installation. The powder store may for example be connected in a powder-conducting manner to the metering device via a powder-conducting line. This allows the powder store or a powder storage container to be arranged at a particularly favourable or any desired location of the powder coating installation, which is suitable in particular for refilling with powder.

According to yet another embodiment, the metering device has an electrically activatable transmitter. By means of the transmitter, a supply of an amount of powder per unit of time to the electrode arrangement can be variably set. It may for example be settable in discrete steps but also steplessly. Depending on the design of the metering device, the transmitter interacts mechanically with the screen or with the slide of the metering device. The transmitter may for example have a crank drive, by means of which the slide can be moved reversibly, that is to say forward and back, in a longitudinal direction. The slide may in particular be connected by way of a connecting rod to a crank drive and be guided longitudinally displaceably along a longitudinal guide of the metering device.

If the metering device has a screen, it is also conceivable to mount the screen movably with respect to a powder supply or the powder store. The electrically activatable transmitter may in this case be designed for example to strike laterally against the screen and subject it regularly to impact forces or mechanical pulses, in order that a defined amount of powder is discharged from the screen downward, via the powder outlet. The transmitter may in this case likewise have a crank drive provided with a connecting rod. It is however also conceivable to implement a magnetically activatable transmitter, for example in the form of an electrically activatable solenoid or a linear motor. By correspondingly applying an electrical current, it is possible for example for a piston displaceably mounted in an electromagnet to be moved forward and back, so that it strikes laterally against the screen of the powder outlet.

The frequency and/or the amplitude of the transmitter interacting with the screen or with the slide may typically be changed variably or else steplessly by means of a controller of the powder coating device. In this way, the amount of powder discharged by the metering device per unit of time can be modified and set specifically and also in a variable and remotely controlled manner during the coating operation.

According to yet another embodiment, the electrode arrangement is aligned in an inclined manner with respect to a horizontal. The electrode arrangement may typically have a planar electrode with a predetermined area extent. The electrode arrangement may in particular have a rectangular or square contour. It may be aligned in an inclined manner with its surface normal with respect to the vertical, typically in an angular range of 0° to 45°. If the electrode arrangement is in an inclined alignment with respect to the horizontal, it has at least one upper-lying region, with respect to the vertical, and at least one lower-lying region.

It is typically provided here that, in the case of an inclined arrangement, the upper-lying region of the electrode arrangement is at a smaller horizontal distance from the metering device in comparison with the lower-lying region. In other words, considered horizontally, the upper-lying region of the electrode arrangement is arranged closer to the powder outlet of the metering device than is the case for the lower-lying region of the electrode arrangement. It can be achieved in this way that the powder discharged from the powder outlet impinges on the upper-lying region of the electrode arrangement and, in the course of the generation of the powder cloud, or when it falls down under the effect of gravity from the powder cloud, lands once again on the electrode arrangement. Powder particles that are electrostatically charged multiple times during the coating process and fall down under the effect of gravity multiple times onto the electrode arrangement undergo a horizontal movement toward the lower-lying region of the electrode arrangement. A downward inclination of the electrode arrangement, away from the metering device, consequently brings about a certain movement of the powder on the electrode arrangement.

With a powder discharge of the metering device onto the electrode arrangement that is set correctly for the respective coating operation, it is possible in this way to achieve a distribution of the powder on the surface area of the electrode that remains the same during the coating process and is as homogeneous as possible. This is advantageous for generating the powder cloud homogeneously in spatial terms and stably over time. If required, a powder cloud that can change over time and/or is inhomogeneous in spatial terms can also be generated.

According to yet another embodiment, it is provided in particular that the powder coating device is arranged above a bottom of the coating chamber of the powder coating installation. Consequently, the lower-lying region of the electrode arrangement is located above the bottom of the coating chamber. With an inclined alignment of the electrode arrangement, it is accepted that a certain amount of powder trickles down from the lower-lying region of the electrode arrangement onto the bottom of the coating chamber and is consequently removed from the powder coating process. This is not however in any way disadvantageous for the powder coating process, since a required amount of powder can be fed to the coating process at any time by means of the metering device.

According to yet another embodiment, the electrode arrangement is arranged pivotably or variably changeably on the main body. The pivotable arrangement, in particular with respect to a horizontally running pivot axis, allows an alignment of the electrode arrangement with respect to the horizontal that is variable and can be changed or adjusted in a way corresponding to the corresponding coating specifications. The electrode arrangement can in this case be fixed on the main body in any inclined alignment that can be adopted. An alignment or inclination of the electrode arrangement that can be variably set allows the particle density in the powder cloud and the spatial extent of the powder cloud and also the homogeneity of the powder distribution over the surface area of the electrode arrangement to be specifically set according to the amount of powder fed.

According to yet another embodiment, provided on the main body is at least one fastening element, which is designed for forming a releasable fastening with a corresponding counter-fastening element provided in a coating chamber of a powder coating installation. By means of the at least one fastening element, preferably by means of a number of fastening elements, the main body, and consequently the entire powder coating device, can be variably arranged at locations provided for this, and provided with corresponding counter-fastening elements, in or on the coating chamber of the powder coating installation.

It is in particular conceivable that a multiplicity of counter-fastening elements, which allow a variable and changeable arrangement of the powder coating device at different locations in or on the coating chamber, are provided on the coating chamber or the powder coating installation. In this way, a powder coating installation can be variably converted and can be configured for a wide variety of coating processes.

Furthermore, it is conceivable to arrange a number of the previously described powder coating devices in a coating chamber. Thus, for example, two or more powder coating devices may be arranged with their respective main bodies or carriers for example on opposite side walls of the coating chamber, so that a workpiece or object to be coated can be arranged for example between two opposite powder coating devices inside the coating chamber.

The use of a number of powder coating devices and/or the fact that the powder coating devices can be variably arranged inside the coating chamber also allow in-line or run-through operation of workpieces or objects to be coated through the coating chamber. The metering device allows continuous replenishment of powder coating material, so that the coating operation does not have to be interrupted for the purpose of replenishing powder. This allows stable and monitorable long-term and run-through operation of a powder coating device or of a powder coating installation equipped with it. The production efficiency for coating individual objects or workpieces can in this way be increased and cycle times can be shortened.

According to yet another embodiment, at least one wall portion is arranged on the main body of the powder coating device. This can be integrated into a boundary wall of a coating chamber of a powder coating installation. By means of the wall portion arranged on the main body, it is possible for example for wall portions designed as corresponding thereto of a boundary wall or else an entire boundary wall of a coating chamber to be substituted.

Thus, it is conceivable in principle to arrange the powder coating device not only inside, and consequently on an inner side of a boundary wall of the coating chamber of a powder coating installation, but also to provide a coating chamber of a modular construction, which has at least one boundary wall or a wall portion thereof that is removable and can be removed from the chamber. Then, the powder coating device with its wall portion provided on the main body can substitute and replace the wall portion taken out and removed from the chamber or a corresponding boundary wall. In this way, the powder coating device can be designed as a module of a powder coating installation that contributes to the formation of a coating chamber.

In any case, the powder coating device may have a structural unit, formed by the main body, the metering device and the electrode arrangement, that can be releasably arranged flexibly and variably in or on a coating chamber of a powder coating installation.

According to another aspect, the present invention also relates to a powder coating installation for the powder coating of objects. The powder coating installation has a coating chamber and a powder storage container and also at least one previously described powder coating device. This device can be variably positioned in or on the coating chamber. The powder storage container may be located inside, but also outside the coating chamber. In particular if the powder coating device is designed with a wall portion for the substitution of a boundary wall or a portion corresponding thereto of a boundary wall of the coating chamber, it may be provided to arrange a powder store or powder storage container outside an outer side or on an outer side of the wall portion and to arrange the metering device, or at least its powder outlet, on an inner side of the wall portion.

The electrode arrangement is located on an inner side of the wall portion or at a distance from it inside the coating chamber. In this way, when arranged as intended on the coating chamber, the powder coating device designed as a coating module can form a boundary wall of the coating chamber or contribute to the formation of a boundary wall of the coating chamber.

According to another embodiment, the coating chamber has a chamber bottom, which has at least in a portion thereof a collecting region for powder material narrowing downwardly in the form of a funnel. The chamber bottom may for example be designed in a V-shaped manner. It may however also have a narrowing that tapers downwardly in a trapezoidal or pyramidal manner. A chamber bottom that is inclined at least in a portion thereof is suitable for collecting excess powder, for example trickling down from the lower-lying region of the electrode arrangement.

According to yet another embodiment, the powder coating installation is equipped with a powder return, which is connected by an end portion in a powder-conducting manner to the collecting region of the chamber bottom and which is connected by an opposite end portion in a powder-conducting manner to the powder storage container. In this way, the powder material collecting on the bottom of the coating chamber can be returned into the powder storage container. The consumption of powder material can in this way be lowered and process costs can be reduced.

The powder return may have a tube or pipe connection, which extends from the outlet of the collecting region to an inlet of the powder storage container. The transporting of powder via the powder return may take place for example by means of a blower or by a suction extractor. The blower or the suction extractor may in this case be hermetically separated from the interior space of the coating chamber, so that the spread of the powder cloud inside the coating chamber is not influenced, or only imperceptibly, by the blower or by the suction extractor.

According to yet another embodiment, the powder return has an intermediate storage container. The intermediate storage container may be arranged in particular between the collecting region and the powder storage container. By means of the intermediate storage container, a removal of powder material from the collecting region can be isolated from a supply of powder material to the powder storage container. By means of the intermediate storage container, a removal of powder material from the collecting region can take place far more often than a supply of powder material into the powder storage container. Moreover, by means of the intermediate storage container, the powder receiving capacity of the powder coating installation can be increased.

According to yet another embodiment, the powder coating installation has on or in the coating chamber a number of counter-fastening elements for a variable arrangement of one or more previously described powder coating devices. It is also conceivable that the powder coating installation has a carrying structure for the coating chamber arranged outside the coating chamber. In this way, the coating chamber can itself be fastened to the carrying structure. Furthermore, the carrying structure, for example in the form of a carrier framework, allows a modular construction of the coating chamber. Individual boundary walls or wall portions of the coating chamber can be arranged separately and independently of one another on the carrier structure.

In a way similar or identical to the main body of the powder coating device, at least one boundary wall or a wall portion thereof may have at least one or more fastening elements. The carrier structure may have equivalent counter-fastening elements corresponding thereto. Consequently, either individual boundary walls or wall portions of the coating chamber of the powder coating installation and/or individual powder coating devices that are respectively designed with wall portions may be arranged on the carrier structure. In this way, individual boundary walls of the coating chamber or individual wall portions thereof can be substituted by wall portions of a powder coating device.

This allows a modular construction of the powder coating installation, which in this way can be adapted comparatively easily and quickly to different coating requirements.

According to yet another embodiment, the counter-fastening elements, which are arranged either on the carrier structure or on or in the coating chamber, have at least one or more elongated fastening rails. Fastening rails allow a variable, possibly stepless spatial positioning of the powder coating device inside the coating chamber. The at least one or more fastening rails may in this case be aligned horizontally, vertically or else in an inclined manner at a predetermined angle with respect to the horizontal. It is also conceivable to displaceably arrange individual, for example horizontally running, fastening rails in turn on vertically running fastening rails. In this way, it is possible to provide that the powder coating device can be positioned two-dimensionally as desired, possibly steplessly, in or on the coating chamber.

According to one embodiment, it is provided that the powder coating installation has at least two or more of the previously described powder coating devices. With respect to a vertical, these are arranged one above the other in the coating chamber.

According to yet another embodiment, the powder coating installation has at least two or more of the previously described powder coating devices, which are arranged with respect to a horizontal one behind the other or one next to the other in the coating chamber.

It is also conceivable that in each case at least one or more of the previously described powder coating devices is arranged or are arranged on opposite side wall portions of the coating chamber. It is also conceivable that in each case at least one or more previously described powder coating devices, or corresponding coating modules, are arranged not only on opposite side wall portions of the coating chamber but also on side wall portions of the coating chamber adjacent to one another.

According to yet another embodiment, it is also provided that at least one of the previously described powder coating devices is arranged on a top portion of the coating chamber.

The releasable arrangement of the powder coating device on or in a coating chamber allows a large variety of configurations with regard to the number, the positioning, the distance and the alignment of individual powder coating devices or coating modules in or on a coating chamber of a powder coating installation. Consequently, different powder clouds that have a shape and/or particle density that is as optimum as possible in each case for the coating of the workpieces can be respectively generated for the coating of a wide variety of workpieces and objects.

According to yet another embodiment, the powder coating installation has at least one boundary wall or a wall portion belonging to the boundary wall that can be released from the coating chamber and can be substituted by a wall portion of a previously described coating device. The boundary wall and/or a wall portion belonging to the boundary wall concerned may for example be arranged on a carrier structure that is located outside the coating chamber. The carrier structure and the boundary wall or the wall portion may have fastening elements and counter-fastening elements that are made to match one another, which are for example subject to a certain geometrical standardization.

The powder coating device, in particular the fastening elements provided on it, may correspond to the counter-fastening elements provided on the carrier, so that a boundary wall or a wall portion of the coating chamber belonging to the boundary wall can be replaced according to requirements by a wall portion of the powder coating device. In the course of this, a powder coating device is fastened instead of a boundary wall or an associated wall portion on the carrier structure and the powder coating installation can be equipped with a metering device likewise arranged on the powder coating device concerned and an associated electrode arrangement.

It is also conceivable that wall portions of the coating chamber that can be arranged next to one another have in each case fastening elements and counter-fastening elements corresponding to one another, so that wall portions of the coating chamber arranged next to one another or one above the other can be connected to one another and/or can be fastened to one another. This equally applies also to such wall portions that are arranged on the main body of the powder coating device. With such a fastening of wall portions to one another, it is possible to dispense with a separate attachment and fastening in each case of wall portions to the carrier structure. As a result, the construction of the powder coating installation can be simplified. It may be that it is possible to dispense with a carrier structure for the formation of the coating chamber. This can have advantageous effects on the production costs and the space requirement of the powder coating installation.

BRIEF DESCRIPTION OF THE DRAWING FIGURES

Further objects, features and advantageous application possibilities of the powder coating device and the powder coating installation will be readily apparent to those of ordinary skill in the art from the following detailed description of exemplary embodiments with reference to the accompanying drawing figures.

FIG. 1 shows a schematic representation of an isolated powder coating device according to an exemplary embodiment of the present invention.

FIG. 2*a* shows a metering device for the powder coating device of FIG. 1 with a slide in a receiving position.

FIG. 2*b* shows the metering device according to FIG. 2*a* with the slide in the discharging position.

FIG. 2*c* shows the metering device according to FIG. 2*a* and FIG. 2*b* with the slide located in an intermediate position.

DETAILED DESCRIPTION OF EXEMPLARY EMBODIMENTS

Figure 1:
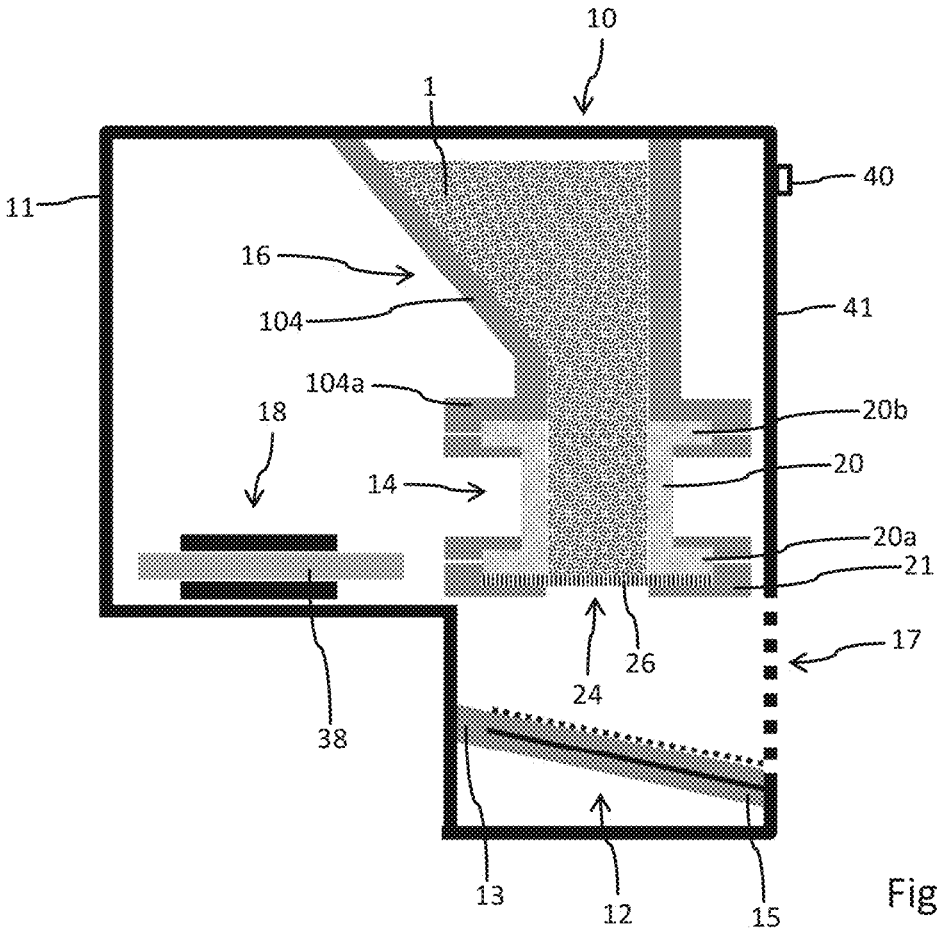
Figure 5:
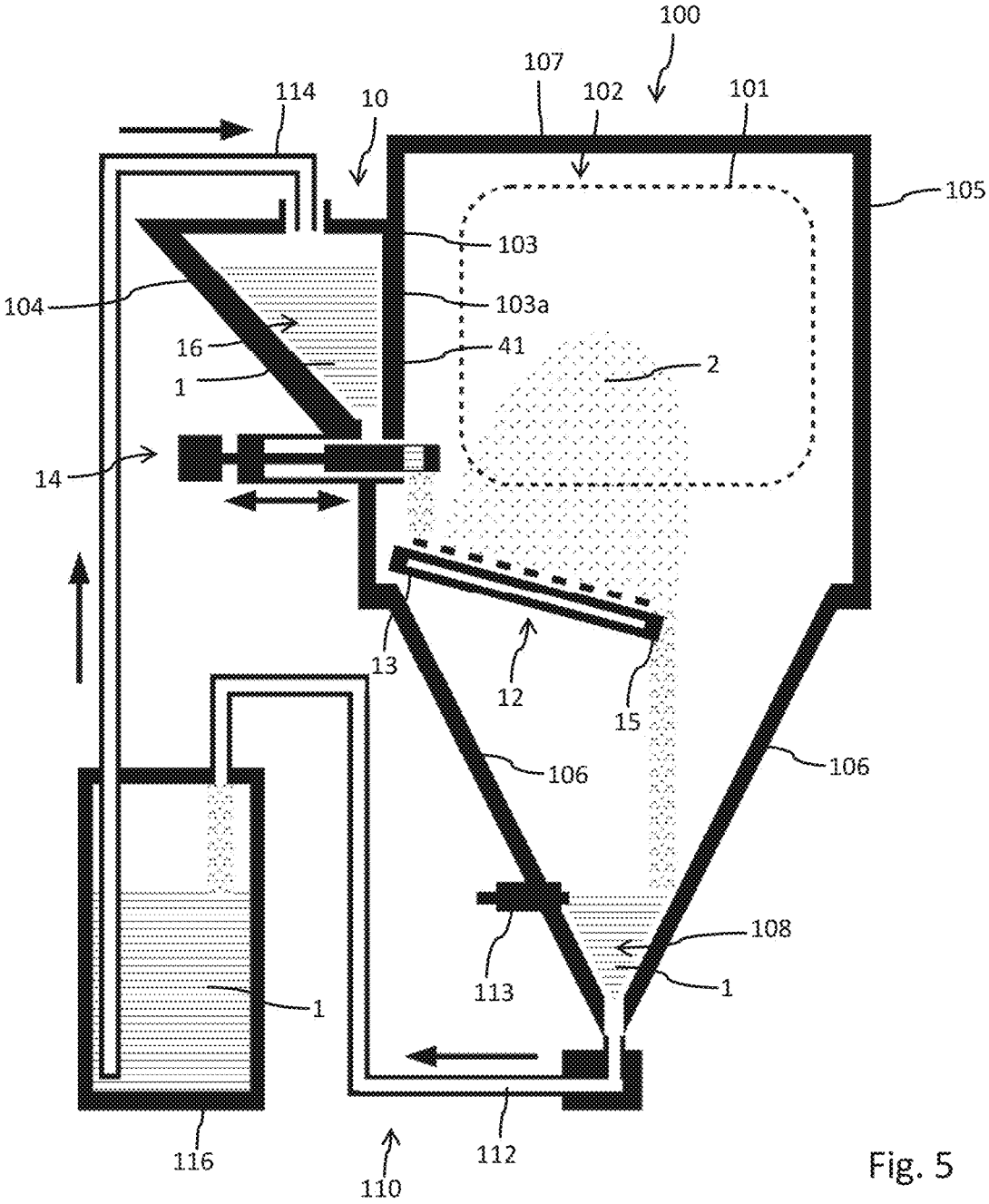
FIG. 5 shows a schematic representation of a powder coating installation according to the present invention equipped with the powder coating device of FIG. 1.
Figure 6:
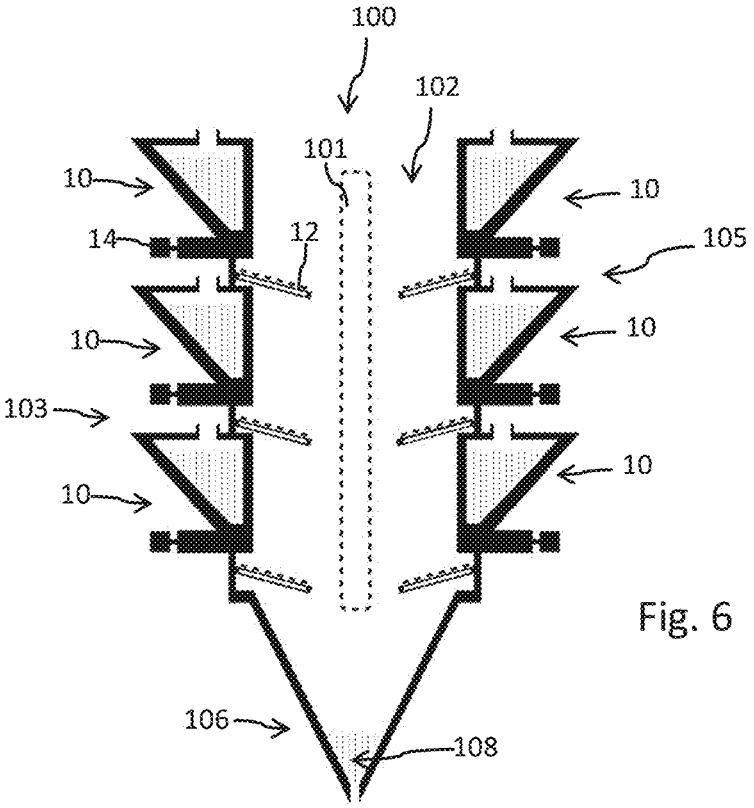
FIG. 6 shows another exemplary embodiment of a powder coating installation according to the present invention with altogether six powder coating devices.

In FIG. 1 and FIG. 5, the construction of a powder coating device 10 is schematically shown. The powder coating device 10 has a main body 11, which at the same time acts as a carrying structure for individual components of the powder coating device 10. The powder coating device 10 has at least one electrode arrangement 12, which is designed for generating a powder cloud 2 and is arranged on the main body 11. Also arranged on the main body 11 is a metering device 14. With respect to a vertical, this device is located above the electrode arrangement 12. The metering device 14 is provided in particular with a powder outlet 24, by means of which a predetermined amount of a powder material can be discharged and can reach the electrode arrangement 12 under the effect of gravity. On the electrode arrangement 12, the powder material 1 undergoes electrostatic charging, which leads to the formation of a powder cloud 2, as schematically indicated in FIG. 5.

The electrode arrangement 12 and the metering device 14 may be arranged in a fixed or variably changeable manner on the main body 11 of the powder coating device 10. The powder coating device 10 or its main body 11 can be arranged variably in a coating chamber 102 of a powder coating installation 100 schematically shown in FIG. 5. The variable arrangement, that can be configured as desired, of the powder coating device 10 in or on the powder coating installation 100 allows the generation of powder clouds 2 of a wide variety of geometries and also with different particle or powder densities.

Figure 3:
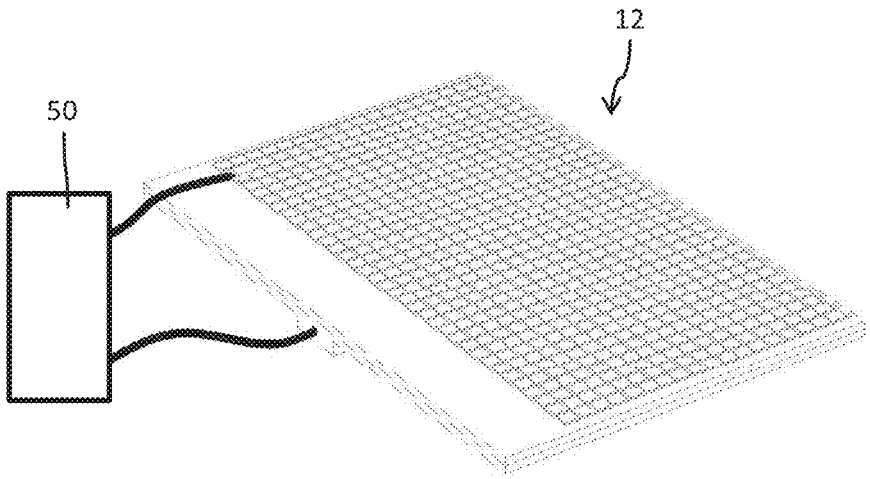
FIG. 3 shows a perspective schematic representation of an electrode arrangement for the powder coating device of FIG. 1.
Figure 4:
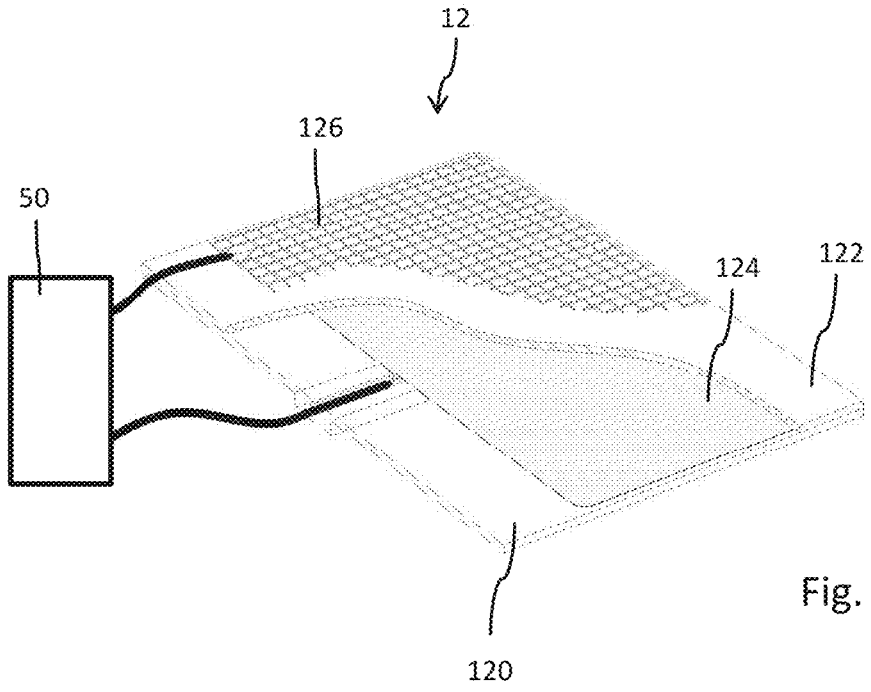
FIG. 4 shows a partially sectioned representation of the electrode arrangement according to FIG. 3.

The electrode arrangement 12, which is shown separately in FIGS. 3 and 4, has an extensively planar-designed two-dimensional structure. The electrode arrangement 12 may for example be designed in a rectangular or square manner. The electrode arrangement 12 may be of a multi-layered construction. It may have a lower layer 120 and an upper layer 122. The lower layer 120 and the upper layer 122 are typically produced from an insulating material. Between the two layers 120, 122 there is an electrode 124. The electrode 124 is designed as a flat electrode and predominantly fills a region between the layers 120, 122. A pulsed high voltage is typically applied to the electrode 124. For example, a high voltage in the range of 10 kV to 25 kV may be applied to the electrode 124. Typical frequencies for the high-voltage excitation lie in the range of 20 Hz to 100 Hz, preferably in the range of 40 Hz to 60 Hz, for example in a range of approximately 50 Hz.

Arranged on the upper side of the upper layer 122 that is facing away from the lower layer 120 is a grid electrode 126. This has a grid-shaped structure and extends almost over the entire outer surface of the upper layer 122. A high-voltage DC voltage in the range of 5 to 50 kV is typically applied to the grid electrode. The grid electrode 126 provides electrostatic charging of the powder material 1 located on the upper side of the electrode arrangement 12. The pulsed electrode 124 brings about a kind of periodic pulse charging of the powder material 1 and assists the formation of a powder cloud 2 moving away spatially from the upper side of the electrode arrangement 12. Both electrodes, the electrode 124 and the grid electrode 126, are connected to a control unit 50. The electrodes 124, 126 may be galvanically isolated from one another.

As also shown in FIGS. 1 and 5, the electrode arrangement 12 is arranged in a tilted manner with respect to a horizontal. It has with respect to the vertical an upper region 13 and a lower region 15. With a planar design of the electrode arrangement 12, the upper region 13 and the lower region 15 mark opposite side edges of the electrode arrangement 12. In the present case, it is provided that, with respect to a horizontal, the upper region of the electrode arrangement 12 is arranged closer to the outlet 24 of the metering device 14 than the lower region 15. In this way, it can be ensured that the powder material 1 discharged from the metering device 14 first impinges on the upper region 13 of the electrode arrangement 12 and from there is discharged to a powder cloud 2.

Since the deposition rate of powder material 1 from the powder cloud 2 onto an object to be coated is limited and the powder cloud is subject to the effect of gravitational force, individual powder particles of the powder cloud steadily sink down onto the electrode arrangement 12. As a result, a uniform distribution of powder material 1 takes place on the upper side of the electrode arrangement 12, as is indicated in FIGS. 1 and 5. Moreover, the inclined alignment of the electrode arrangement 12 allows the geometry of the powder cloud 2 that is formed to be influenced and monitored. The electrode arrangement 12 may in particular be arranged pivotably on the main body 11 of the powder coating device 10. It may in particular be mounted pivotably on the main body 11 with regard to a horizontally running pivot axis. It is also conceivable that the electrode arrangement can be fastened multiply and separately to the main body 11 by regions that are opposite one another or at a distance from one another. Thus, an alignment and arrangement and also fixing of the electrode arrangement 12 that can be inclined as desired can also take place in this way on the main body 11.

As shown in particular in FIG. 1, the main body 11 may form a kind of closed housing of the powder coating device 10. Above or to the side of the electrode arrangement 12, the main body 11 has in this case an outlet opening 17 for the powder cloud. As a departure from this, however, it is also conceivable that the electrode arrangement 12 is arranged outside an enclosure or a housing of the main body 11.

In the specific design of the metering device 14 according to FIG. 1, it has a screen 26 that is made to extend over the powder outlet 24. The screen 26 prevents unrestrained trickling down or falling down of powder material 1 from a powder store 16 located above the powder outlet 24. The powder store 16 may be enclosed by a powder storage container 104. The powder storage container 104 may likewise be a component part of the powder coating device 10. It may however also be arranged outside the powder coating device 10 and merely be connected or coupled in a powder-conducting manner to the metering device 14.

The metering device 14 according to FIG. 1 has adjacent to the screen 26 and counter to the delivery direction for the powder material 1 a deformable or flexible powder guide 20. The powder guide 20 may be for example a flexible tube or a flexible piece of line, by means of which the powder outlet 24 is connected to the powder storage container 104. The powder storage container 104 may have in particular a connection piece 104*a* for the powder guide 20. Facing away from the powder storage container 104, the powder guide 20 may have a stub 21 for receiving and/or fastening the screen 26. The stub 21 may have a flange-like widening. The powder guide 20 may also have respectively in the direction of the connection piece 104*a* and in the direction of the stub 21 a flange-like widening 20*a*, 20*b*, by means of which a form-fitting fastening of the powder guide 20 with respect to the powder storage container 104 and with respect to the stub 21 is possible. The powder guide 20 may be designed for example in the form of a flexible silicone tube.

The metering device 14 is also equipped with a transmitter 18. This is arranged at the height of the powder outlet 24, therefore at the height of the screen 26. In the present case, the transmitter 18 is arranged at the height of the stub 21 and outside the stub 21, laterally adjacent to the stub 21. The transmitter 18 has in the present case an electrically activatable solenoid 38, which is designed to respond to the application of an electrical control signal by correspondingly striking laterally against the stub 21 in a regular and/or repeated manner, in order thereby to exert a mechanical pulse on the movably mounted screen 26. In this way, the solenoid 38 can exert a kind of knocking movement on the flexibly mounted screen 26, so that a defined amount of powder is discharged from the screen. The design shown here is advantageous to the extent that the movably mounted parts do not undergo any friction or abrasion, which could for example contaminate the powder material 1. Any powder material 1 that may become attached to the outside of the powder guide 20 can be knocked off by means of the transmitter 18. To this extent, the transmitter 18 counteracts attachment of powder to the movable components of the metering device 14.

Figure 2A:
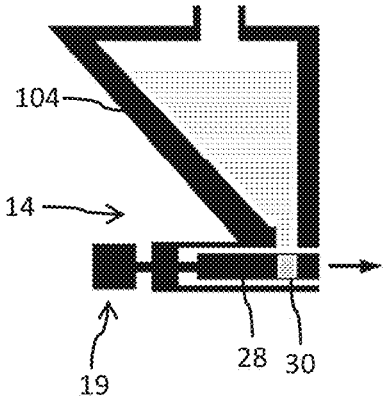
Figure 2B:
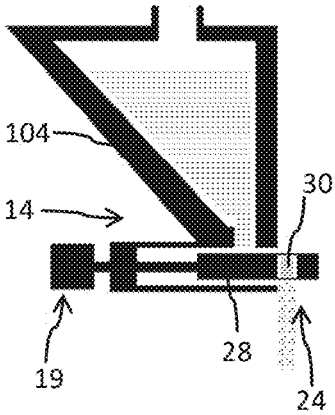
Figure 2C:
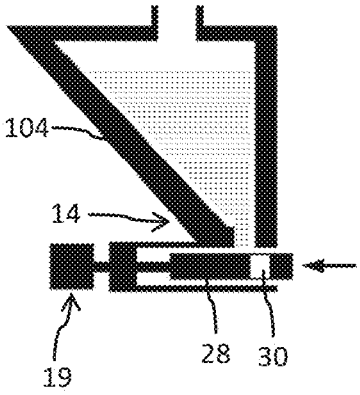

In FIGS. 2*a* to 2*c*, a further design of a metering device 14 is shown. Instead of a powder guide 20 forming an extension of a powder store 16 and a screen 26, this device has a movable slide 28. The slide 28 has a receptacle 30 for an amount of powder. The slide 28 is guided longitudinally displaceably on the metering device 14, between a receiving position shown in FIG. 2*a* and a discharging position shown in FIG. 2*b*. The receptacle 30 is upwardly and downwardly open. In the receiving position shown in FIG. 2*a*, the receptacle 30 is located under an outlet of the powder storage container 104. In this position, the receptacle 30 can be filled with powder material 1. Then, the slide 28 can be transferred into the discharging position shown in FIG. 2*b*, in which the slide 28 protrudes with its receptacle 30 out of a housing of the metering device 14. Since the receptacle 30 is downwardly open, the amount of powder 1 located in the receptacle 30 can be discharged downwardly and fed to the electrode arrangement 12. In FIG. 2*c*, an intermediate position of the slide 28 is shown. The arrow reproduced there shows the momentary direction of movement of the slide 28 toward the receiving position.

As an alternative to the exemplary embodiment of FIGS. 2*a* to 2*c*, it is conceivable that the slide 28 is not mounted horizontally and longitudinally displaceably, but rotatably. For this case, a through-opening may be provided on an underside of the housing of the metering device 14, arranged offset in relation to an outlet of the powder storage container 104. By means of a rotatable slide 28, the receptacle 30 can be moved into the region of a through-opening on the underside of the housing of the metering device 14, through which through-opening the amount of powder can be discharged. It is equally conceivable that the slide 28 is moved completely within the housing of the metering device 14 and that the receptacle 30 in the discharging position comes to lie in line with a downwardly open through-opening of the housing.

As shown in FIG. 5, the powder coating installation 100 has at least one previously described powder coating device 10. The powder coating device 10 may also have a wall portion 41, which is designed for and dimensioned in such a way as to substitute a wall portion 103*a* or an entire boundary wall 103 of the coating chamber 102. In the exemplary embodiment shown in FIG. 5, a boundary wall of the powder storage container 104 coincides with the wall portion 41 of the powder coating device 10.

The powder coating device 10 can be releasably arranged together with this wall portion 41 on the coating chamber 102 or on a carrier structure 111 that is not explicitly shown in FIG. 5. In the configuration shown in FIG. 5, the electrode arrangement 12 is located above a chamber bottom 106. It protrudes laterally from a side wall portion 103 of the coating chamber 102 into the interior volume of the coating chamber. As indicated in FIG. 5, a powder cloud 2, which ideally fills as completely as possible a coating region 101 designed for receiving coating objects, forms during the operation of the powder coating installation 100.

The chamber bottom 106 is aligned in an inclined manner, at least in a portion thereof. It may have a recessed collecting region 108. In particular, the chamber bottom 106 may be designed in the form of a funnel, for instance one-dimensionally or two-dimensionally in the form of a funnel. The chamber bottom 106 may taper downwardly, narrowing in the form of a cone, in the manner of a tetrahedron or in the manner of a truncated pyramid. In this way, a narrowing collecting region 108 can be formed, by means of which the powder material 1 trickling down for example from the electrode arrangement 12, in particular from its lower region 15, can be caught and collected.

The collecting region 108 is also connected to a powder return 110. The powder return 110 has an end portion 112, which is connected in a powder-conducting manner to the collecting region 108 at the bottom of the coating chamber 102. An opposite end portion 114 of the powder return 110 is connected in a powder-conducting manner to an intake or a supply for the powder storage container 104. In this way, excess powder material 1, or powder material 1 collecting on the chamber bottom 106, can be fed once again to the coating process. In this way, a closed circulation is formed. The powder consumption can be minimized.

The powder return 110 may also optionally have an intermediate storage container 116, which is connected in a powder-conducting manner to the end portion 112. The intermediate storage container 116 may also be connected in a powder-conducting manner to the end portion 114. The provision of an intermediate storage container 116 allows frequent removal of powder material 1 from the collecting region 108, without the amount of powder thereby recovered each time having to be fed directly to the powder storage container 104. In particular with the provision of a metering device 14 with a screen 26 provided at the powder outlet 24, it may be advantageous if the powder storage container 104 is not replenished with any further powder material 1 from above during an ongoing coating process.

A filling level sensor 113, by means of which a removal, for example suction removal, of collected powder material 1 from the collecting region 108 can be initiated or triggered, may also be provided at or in the collecting region 108. The filling level sensor 113 is typically coupled to a central controller, for example to the control unit 50. Delivery means, for instance a blower or a suction extractor, for transporting the powder material 1 from the collecting region into the intermediate storage container 116 and into the powder storage container 104 are not explicitly shown in the present case. They may have one or more blowers or suction blowers, which are provided in or on the powder return.

Figure 15:
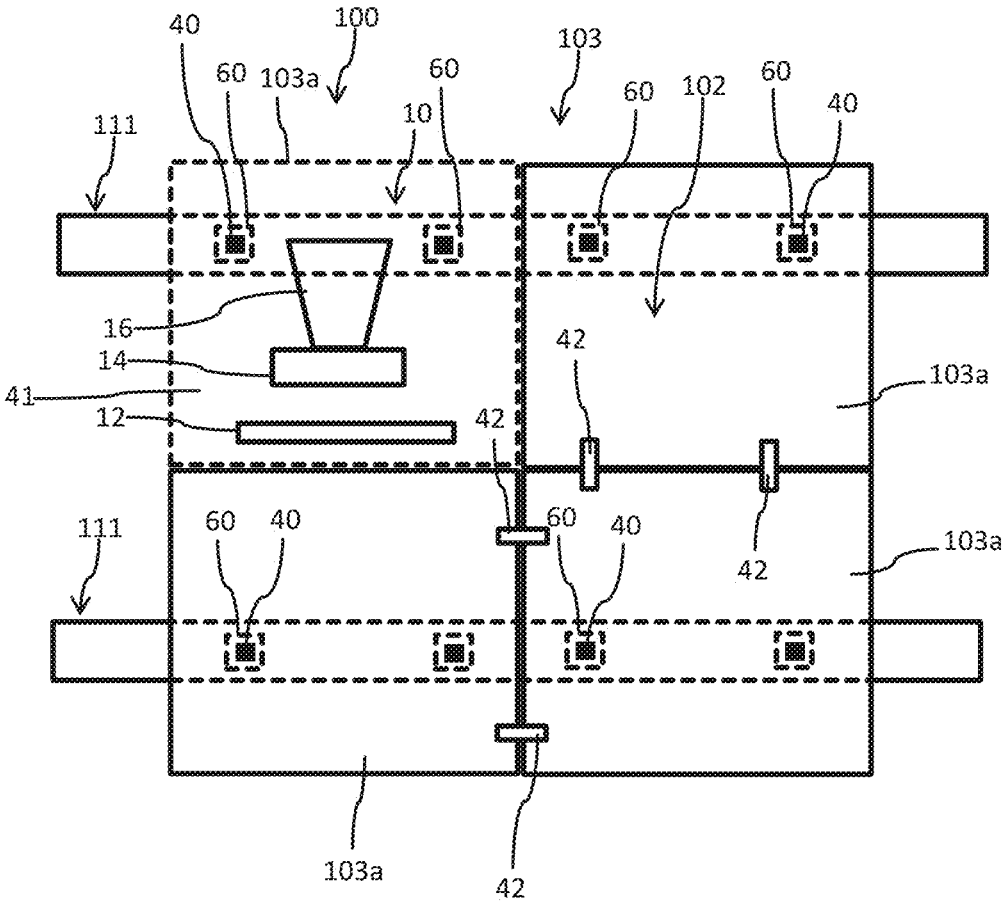
FIG. 15 shows yet another exemplary embodiment of a powder coating installation according to the present invention with exchangeable boundary walls or wall portions.

In the exemplary embodiment according to FIG. 15, the optional modular construction of a coating chamber 102 is shown by way of example in the example of a boundary wall 103, which in the present case is designed as a side wall. The boundary wall 103 has a number of side wall portions 103*a*. These are provided in each case with one or more fastening elements 40, which can be connected to counter-fastening elements 60 designed as corresponding thereto of a carrier structure 111 that is only schematically represented in FIG. 15. The carrier structure 111 may provide a load-bearing framework for the coating chamber 102 or parts thereof.

The mutual connection of fastening elements 40 and counter-fastening elements 60 is releasably designed. In this way, individual side wall portions 103*a* can be released from the carrier structure and removed. Sometimes, the individual side wall portions 103*a* are also releasably connected to one another, thus for instance by means of connecting elements 42. Instead of a wall portion 103*a* designed for example in a planar manner, there may thus also be a powder coating device 10 arranged on the carrier structure 111. The powder coating device 10 has in this case along with the electrode arrangement 12 and the metering device 14 also a wall portion 41, which is formed with regard to size and geometry largely identically to the previously removed side wall portion 103*a* that is represented by dashed lines in FIG. 15. Consequently, the side wall portion 103*a* is substituted by the wall portion 41 of the powder coating device 10. At the same time, this can achieve the effect of arranging the powder storage container 104 outside the coating chamber 102 and the electrode arrangement 12 inside the coating chamber 102.

Figure 13:
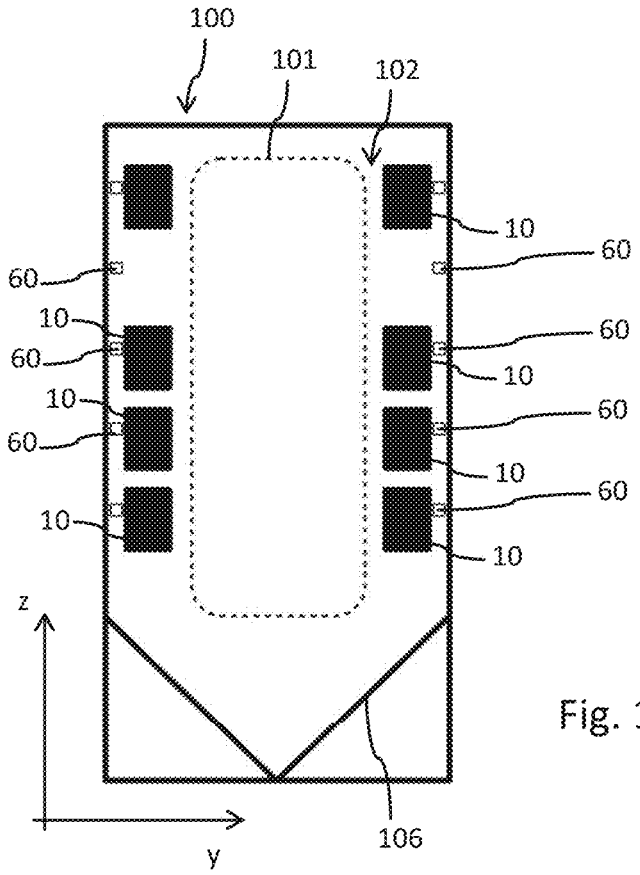
FIG. 13 shows a plan view of yet another exemplary embodiment of a powder coating installation according to the present invention.
Figure 14:
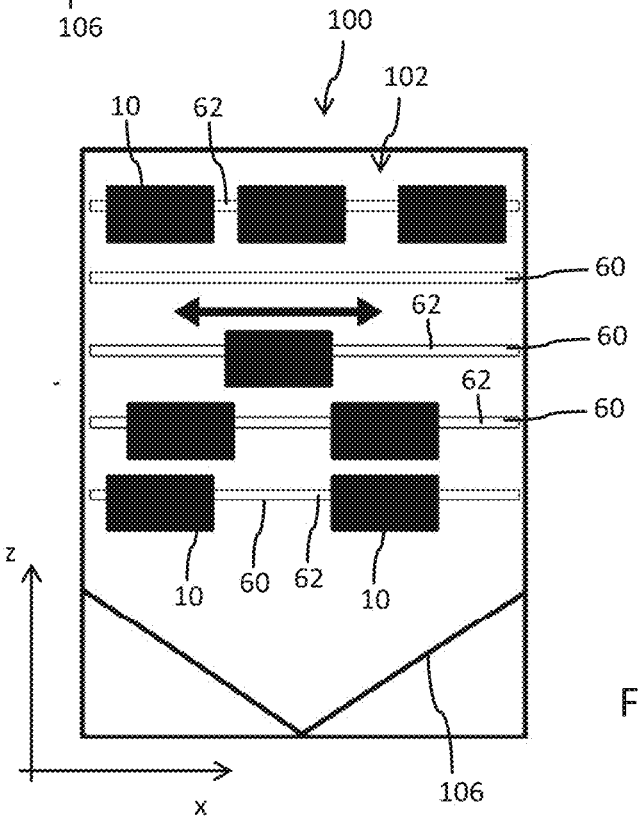
FIG. 14 shows a side view of the powder coating installation according to FIG. 13.

As an alternative to this, it is of course also conceivable to arrange individual counter-fastening elements 60, for example in the form of elongated fastening rails 62, on the inner side of boundary walls 103, 105, 107 inside the coating chamber 102. Thus, for example, in the exemplary embodiments according to FIG. 13 and FIG. 14, provided on the opposite side wall portions 103, 105 there are in each case a number of horizontally running, elongated fastening rails 62, which are arranged one above the other with respect to a vertical and allow a variable arrangement, displaceable in the longitudinal direction, of individual powder coating devices 10 inside the coating chamber 102.

Figure 7:
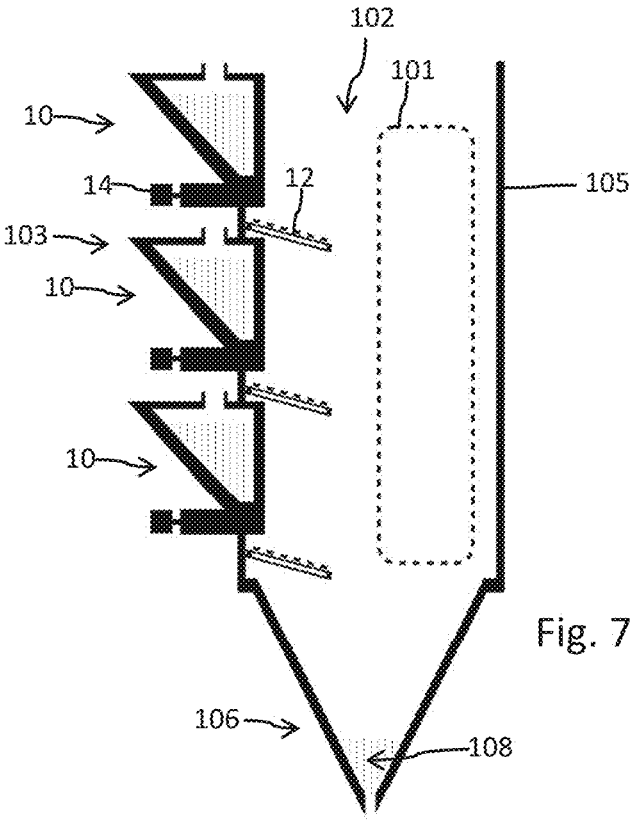
FIG. 7 shows yet another exemplary embodiment of a powder coating installation according to the present invention.

The exemplary embodiments of FIG. 6 to FIG. 14 are greatly simplified and schematized. Only the electrode arrangements 12 and powder storage containers 104 of the respective powder coating devices 10 are shown there. In the design according to FIG. 6, three powder coating devices 10, arranged one above the other with respect to the vertical, are provided in each case on opposite side wall portions 103, 105. These allow the formation of a comparatively elongated, vertically aligned coating region 100. In FIG. 7, only the left-hand side wall portion 103 is provided with three powder coating devices 10 arranged one above the other. Perpendicularly to the opposite side wall portions 105 in the horizontal direction, the powder coating installation 100 according to FIG. 7 to FIG. 9 may also have a number of powder coating devices 10 arranged one behind the other, as shown for example in FIG. 11 and FIG. 14.

Figure 8:
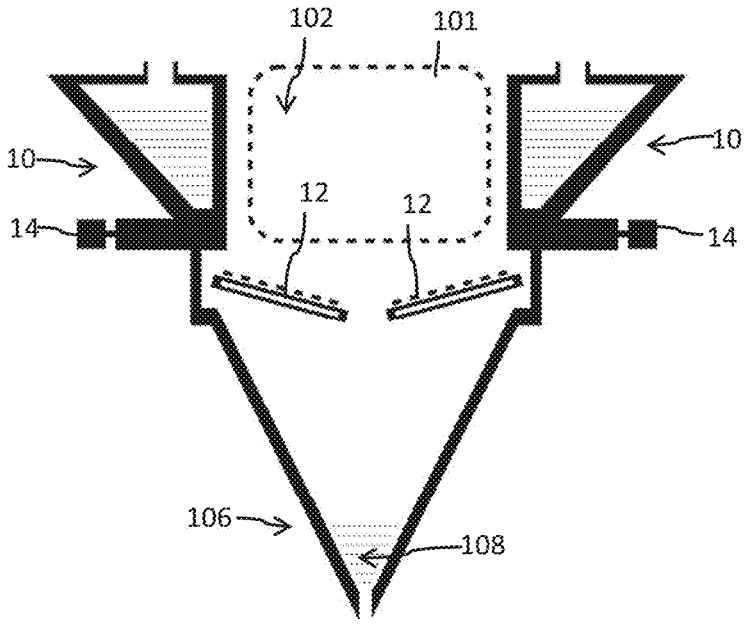
FIG. 8 shows yet another exemplary embodiment of the powder coating installation according to the present invention.
Figure 9:
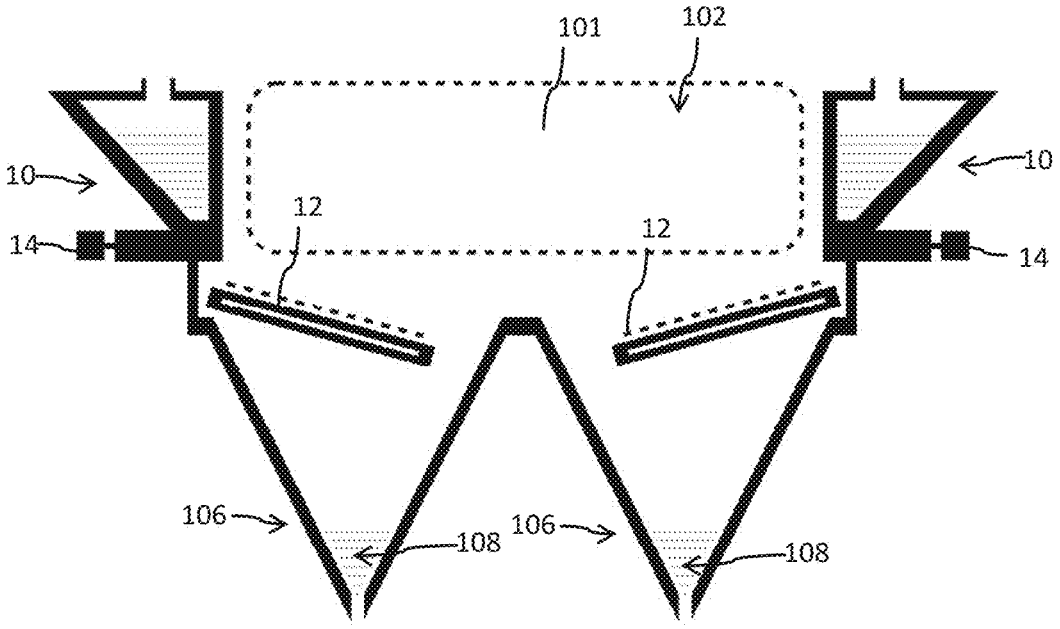
FIG. 9 shows yet another exemplary embodiment of a powder coating installation according to the present invention.

In the exemplary embodiment according to FIG. 8, a powder coating device 10 is respectively arranged on opposite side wall portions 105. The respective electrode arrangements 12 are arranged approximately at the same height, considered in the vertical direction. They have a clear distance between them that is smaller than the horizontal extent of the electrode arrangements concerned. As a difference from this, in FIG. 9 a coating chamber 102 of a comparatively wide design is provided. This has two collecting regions 108, lying next to one another and respectively designed as narrowing downwardly. Above each collecting region 108 there is in each case an electrode arrangement 10.

Figure 10:
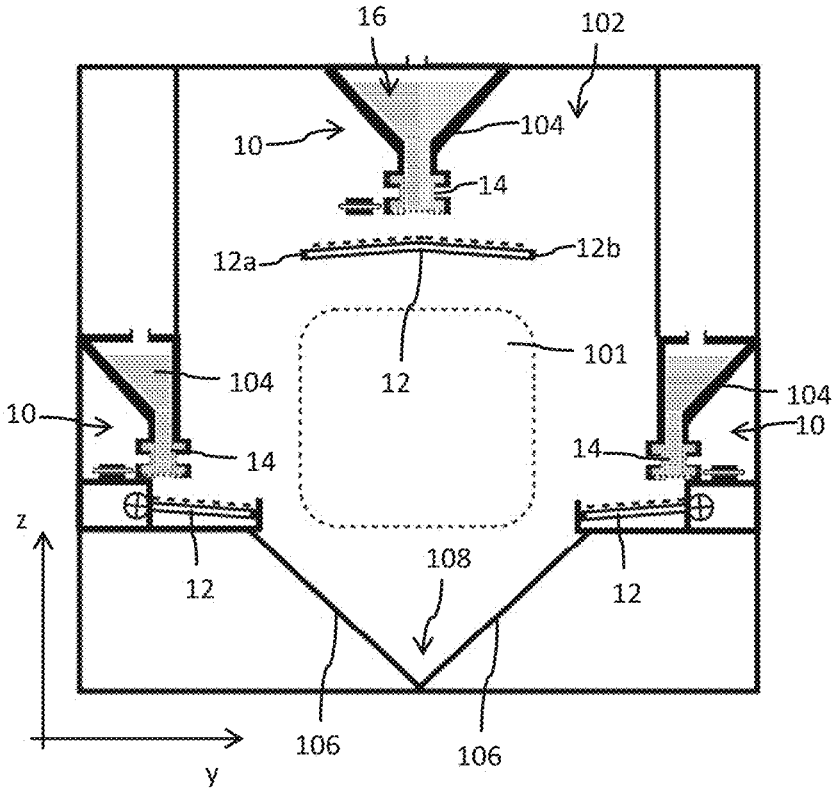
FIG. 10 shows yet another exemplary embodiment of a powder coating installation according to the present invention in a frontal view.

In the further exemplary embodiment according to FIG. 10, a powder coating device 10 is respectively arranged on opposite side wall portions 103, 105. In addition to this, at least one further powder coating device 10 is also arranged on an underside of a top portion 107 upwardly closing the chamber 102. This device has an electrode arrangement 12 comprising two parts or designed in a saddle-like or gable-like manner, with two limbs 12*a*, 12*b*. The limbs 12*a*, 12*b* go over seamlessly one into the other.

With their ends remote from one another, the limbs 12*a*, 12*b* are in each case aligned as slightly inclined downwardly. Each of the limbs 12*a*, 12*b* may have a substantially planar structure. In the transitional region of the limbs 12*a*, 12*b* is the highest point of the electrode arrangement 12, which is typically arranged, with respect to the horizontal, approximately in the middle under the powder outlet 24 of the metering device 14.

Figure 11:
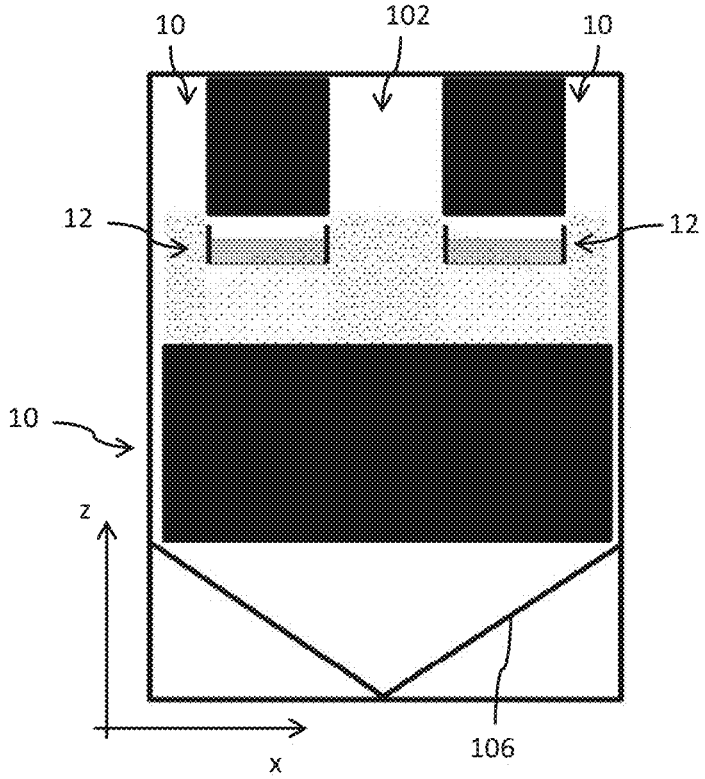
FIG. 11 shows a representation of the powder coating installation according to FIG. 10 in side view.

The powder coating installation 100 is shown in FIG. 10 in a frontal view. In FIG. 11, a corresponding side view is reproduced. There it can be seen that the powder coating devices provided in the region of the side wall portions 103, 105 extend over the entire length of the side wall portions 103, 105 and that two powder coating devices 10, at a distance from one another in the longitudinal direction or in the horizontal, are arranged on the top portion 107.

Figure 12:
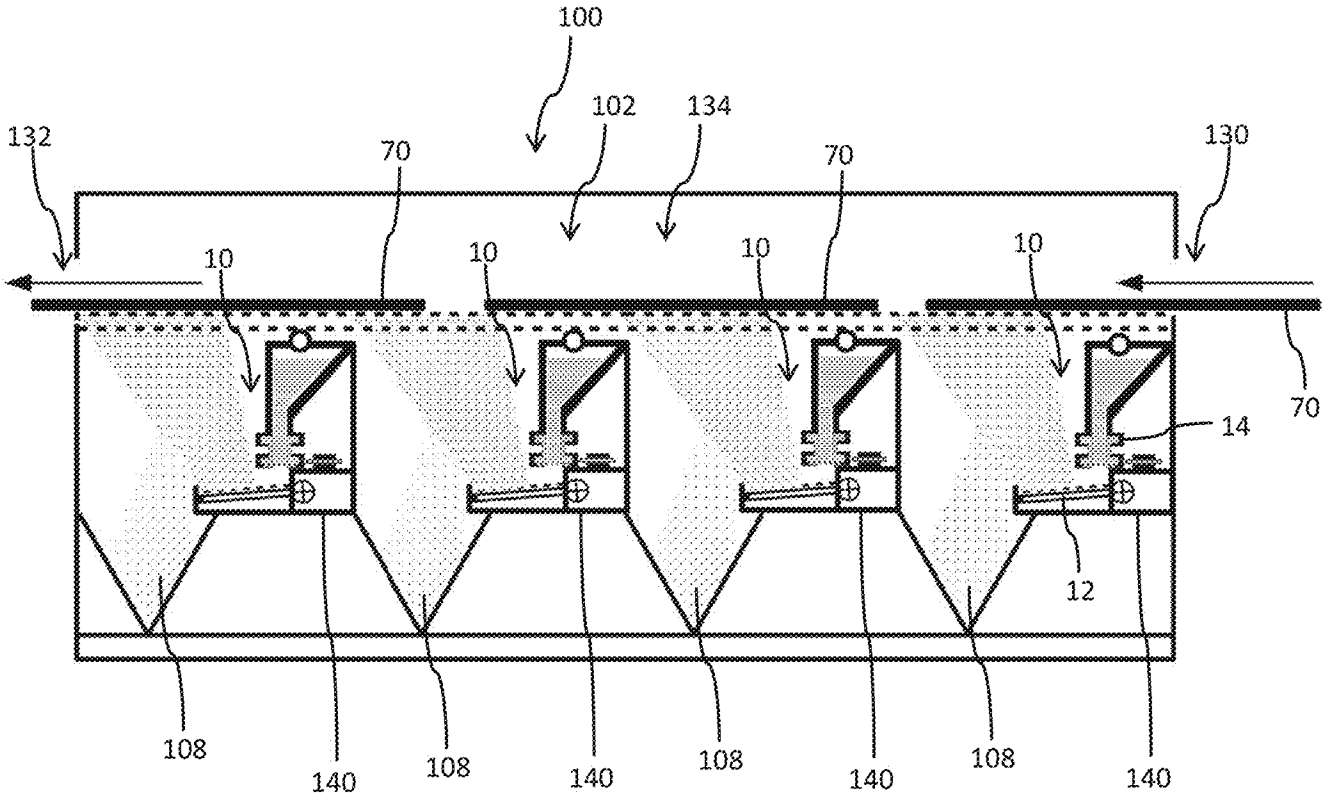
FIG. 12 shows a side view of yet another exemplary embodiment of a powder coating installation according to the present invention that is designed for run-through or in-line operation.

In the representation of a further exemplary embodiment according to FIG. 12, a number of powder coating devices 10 are arranged inside an elongated coating chamber 102. The coating chamber 102, and consequently the entire powder coating installation, is designed for run-through operation. It has a feed opening 130 for coating objects 70 and also an outlet opening 132 for the coated objects 70, provided at an opposite end portion of the coating chamber 102. From the feed opening 130 to the outlet opening 132 there extends a delivery section 134, along which the coating objects are transported.

At least two or more powder coating devices 10 are arranged along the delivery section 134. The powder coating devices 10 are arranged here at a distance from side wall portions 103, 105 on elevated base portions 140 in the middle of the coating chamber 102. Provided between the elevated base portions 140 are collecting regions 108 for powder material 1 occurring in the coating process. As already described above, the collecting regions 108 are connected in a powder-conducting manner to a powder return 110. In the region of the feed opening 130 and the outlet opening 132, air locks may be provided, which are not explicitly shown in the present case and by means of which a hermetic separation of the coating chamber 102 from the outer surrounding area can be obtained. The powder coating installation 100 shown in FIG. 12 allows pressure-less coating of elongated coating objects 70 in a continuous run-through process under atmospheric pressure without the aid of compressed air or similar delivery media.

For the coating process, the coating objects 70 are typically electrically grounded. Even if many of the exemplary embodiments shown in the drawing figures show a metering device 14 that is provided with a movable slide, all of the exemplary embodiments may also be provided with a metering device, as shown in FIG. 1.

The invention claimed is:

1. A powder coating device for the powder coating of objects, comprising a main body, on which an electrode arrangement designed for generating a powder cloud is arranged and on which a metering device designed for a monitored discharge of an amount of a powder onto the electrode arrangement is arranged above the electrode arrangement, wherein the metering device comprises a powder outlet facing the electrode arrangement to enable powder being discharged by the metering device to reach the electrode arrangement under the effect of gravity and to produce a powder cloud that spreads out spatially as a result of electrostatic charging alone, without the application of compressed air or similar delivery of propulsive media.

2. The powder coating device as claimed in claim 1, wherein the metering device has a screen extending over the powder outlet.

3. The powder coating device as claimed in claim 2, wherein the metering device has a movably mounted slide with at least one powder receptacle, by means of which in each case an amount of powder corresponding to the size of the powder receptacle can be fed in portions to the electrode arrangement.

4. The powder coating device as claimed in claim 3, wherein the metering device is connected in a powder-conducting manner to a powder store and wherein the metering device has an electrically activatable transmitter, by means of which a supply of an amount of powder per unit of time to the electrode arrangement can be variably set, and wherein the electrically activatable transmitter interacts mechanically with the screen or with the movably mounted slide.

5. The powder coating device as claimed in claim 1, wherein the electrode arrangement is aligned in an inclined manner with respect to a horizontal, and wherein an upper-lying region of the electrode arrangement, with respect to a vertical, is at a smaller horizontal distance from the metering device in comparison with a lower-lying region of the electrode arrangement.

6. The powder coating device as claimed in claim 1, wherein the electrode arrangement is arranged pivotably on the main body.

7. The powder coating device as claimed in claim 1, wherein provided on the main body is at least one fastening element, which is designed for forming a releasable fastening with a corresponding counter-fastening element provided in a coating chamber of a powder coating installation.

8. The powder coating device as claimed in claim 1, wherein at least one wall portion is arranged on the main body and can be integrated into a boundary wall of a coating chamber of a powder coating installation.

9. A powder coating installation for the powder coating of objects, comprising at least one powder coating device as claimed in claim 1, a coating chamber and a powder storage container, and wherein the at least one powder coating device can be positioned variably in the coating chamber.

10. The powder coating installation as claimed in claim 9, wherein the coating chamber has a chamber bottom, which has at least in a portion thereof a collecting region for powder material narrowing downwardly in the form of a funnel.

11. The powder coating installation as claimed in claim 10, further comprising a powder return, which is connected by an end portion in a powder-conducting manner to the collecting region and which is connected by an opposite end portion in a powder-conducting manner to the powder storage container.

12. The powder coating installation as claimed in claim 11, wherein the powder return has an intermediate storage container.

13. The powder coating installation as claimed in claim 9, wherein a plurality of counter-fastening elements are arranged on or in the coating chamber for a variable arrangement of the at least one powder coating device.

14. The powder coating installation as claimed in claim 13, wherein at least one of the counter-fastening elements has an elongated fastening rail.

15. The powder coating installation as claimed in claim 9, wherein at least one boundary wall of the coating chamber or a wall portion belonging to the boundary wall can be released from the coating chamber and can be substituted by a wall portion of the at least one powder coating device.

16. A powder coating device for the powder coating of objects, comprising a main body, on which an electrode arrangement designed for generating a powder cloud is arranged and on which a metering device designed a for monitored discharge of an amount of a powder onto the electrode arrangement is arranged above the electrode arrangement, wherein the metering device has one of:

(i) a powder outlet facing the electrode arrangement and a screen extending over the powder outlet, and (ii) a movably mounted slide with at least one powder receptacle, by means of which in each case an amount of powder corresponding to the size of the powder receptacle can be fed in portions to the electrode arrangement; and wherein the metering device is connected in a powder-conducting manner to a powder store, and wherein the metering device has an electrically activatable transmitter, by means of which a supply of an amount of powder per unit of time to the electrode arrangement can be variably set, and wherein the electrically activatable transmitter interacts mechanically with the screen or with the movably mounted slide.

* * * * *